US012593892B2

(12) United States Patent
Katzer

(10) Patent No.: US 12,593,892 B2
(45) Date of Patent: Apr. 7, 2026

(54) ORTHOPEDIC PUR FOAM PLASTIC SHOE INSOLE BLANK

(71) Applicant: Spannrit GmbH, Kleinostheim (DE)

(72) Inventor: Roland Katzer, Kleinostheim (DE)

(73) Assignee: Spannrit GmbH, Kleinostheim (DE)

( * ) Notice: Subject to any disclaimer, the term of this patent is extended or adjusted under 35 U.S.C. 154(b) by 0 days.

(21) Appl. No.: 18/994,415

(22) PCT Filed: Oct. 9, 2023

(86) PCT No.: PCT/EP2023/077868
§ 371 (c)(1),
(2) Date: Jan. 14, 2025

(87) PCT Pub. No.: WO2024/079032
PCT Pub. Date: Apr. 18, 2024

(65) Prior Publication Data

US 2025/0261723 A1 Aug. 21, 2025

(30) Foreign Application Priority Data

Oct. 10, 2022 (EP) ..... 22200575

(51) Int. Cl.
*A43B 13/18* (2006.01)

(52) U.S. Cl.
CPC ..... *A43B 13/187* (2013.01)

(58) Field of Classification Search
None
See application file for complete search history.

(56) References Cited

U.S. PATENT DOCUMENTS 4,808,469 A * 2/1989 Hiles ..... A42B 3/125 428/318.6
2004/0025376 A1* 2/2004 Grisoni ..... A43B 13/41 36/44

FOREIGN PATENT DOCUMENTS

| | | | |
|---|---|---|---|
| CN | 207949082 | U | 10/2018 |
| CN | 110065253 | A | 7/2019 |
| DE | 102010015145 | A1 | 10/2011 |
| DE | 102018206906 | A1 | 11/2019 |
| EP | 2929792 | A1 | 10/2015 |
| EP | 3513675 | A1 | 7/2019 |

(Continued)

OTHER PUBLICATIONS

International Search Report & Written Opinion for PCT Application No. PCT/EP2023/077868, mailed Dec. 14, 2023; 17 pages.

*Primary Examiner* — Mohammad M Ameen

(57) ABSTRACT

Orthopedic PUR foam plastic shoe insole blank having at least one cushioning body and a PUR supporting body supporting a foot and three-dimensionally molded in a RIM process. The PUR supporting body has a shoe-side underside and a foot-side upper side, on which an anatomically shaped, orthopedically functional footbed is formed. The at least one cushioning body consists of a prefabricated, two-dimensional PU sheet material that has no carrier layer and that has been manufactured by coagulation, extrusion or from a polyurethane dispersion mixture. The at least one cushioning body is fixed to the upper side and/or the underside of the PUR supporting body by foaming with PUR foam plastic in the shaping RIM foaming mold during the expansion of the RIM foam plastic.

16 Claims, 6 Drawing Sheets

(56) References Cited

FOREIGN PATENT DOCUMENTS

| | | | |
|---|---|---|---|
| EP | 3708018 | A1 | 9/2020 |
| EP | 3981279 | A1 | 4/2022 |
| RU | 1799257 | C | 2/1993 |
| RU | 174557 | U1 | 10/2017 |

* cited by examiner

ORTHOPEDIC PUR FOAM PLASTIC SHOE INSOLE BLANK

FIELD OF THE INVENTION

The present invention relates to an orthopedic foam plastic shoe insole blank with a three-dimensional PUR supporting body molded in a RIM process, on which at least one cushioning body is arranged on the upper side. Furthermore, an orthopedically functional footbed is formed on the upper side of the PUR supporting body. The underside of the PUR supporting body faces the shoe sole. The present invention also relates to a method for manufacturing such a shoe insole blank.

BACKGROUND OF THE INVENTION

Orthopedic PUR foam plastic shoe insole blanks manufactured using the RIM process are known from the prior art, which have a PUR base or supporting body. The function of the base or supporting body is to support and guide the foot in an anatomically and orthopedically functional manner. For this purpose, the base or supporting body is made of a flexible but relatively firm PUR foam plastic, which, in addition to providing orthopedic support, must also provide biometric cushioning, for example when walking, so that abrupt load changes are not transmitted harshly to the foot skeleton. A cushioning body is provided to further cushion the foot movements on the insole and to adjust or equalize the sole of the foot or to reduce pressure peaks on particularly sensitive areas of the sole of the foot. This cushioning body is softer than the PUR support body and can therefore better adapt to the sole of the foot. The better the interaction between the supporting body and the cushioning body or insole cover material, the better orthopedic requirements can be met.

PUR base bodies or supporting bodies are often formed in the shape of a shoe insole by foaming a polyol with an isocyanate in a RIM foaming mold. In this process, the two reactive starting components—the polyol and the isocyanate—are added to an open, usually two-part mold, the cavity of which shows a shoe sole shape. Such RIM foaming molds are well known and are used in the manufacture of orthopedic shoe insole blanks. However, a PUR base or support body produced by the RIM foaming process, especially if it has been manufactured with only one material hardness, does not have an optimal orthopedic effect or optimal wearing comfort over all areas of the sole of the foot. Furthermore, the appearance of such a RIM blank is not always appealing, but this can be improved by covering the supporting body with a cushioning or covering material.

Shoe insole blanks of the state of the art are described, for example, in the documents DE 10 2018 206 906 A, EP 3 981 279 A, EP 3 708 018 A.

As orthopedic shoe insole blanks have different requirements in terms of support and cushioning properties, particularly in the different areas of the sole of the foot, orthopedic shoe insole blanks cannot generally be made with just one material/one material hardness. If, for example, different RIM foams are used, undefined, unpredictable support and cushioning properties occur in the transition areas of the foams, depending on how the foams flow into each other during the foaming process. This and the formation of the material fronts is due to the foam production, which material fronts are not exactly reproducible in a process-stable manner so that exact foot sole area limits can be maintained. For this reason, the PUR support bodies are provided with cushioning bodies and other cover and upholstery materials or orthopedic components that improve the desired orthopedic support and cushioning properties.

As such, individual areas of the sole of a support body, such as the forefoot area or the heel area, are often designed with recesses in order to insert cushioning materials, for example, to cushion and soften the heel bone in a vertical direction, while simultaneously keeping the heel stable and guiding it in horizontal directions. Or reinforcements are inserted or attached in the longitudinal arch area in order to orthopedically functionally reinforce the orthopedic shoe insole blanks in the respective areas. Concurrently, an attempt is made to optimize the desired wearing comfort properties in these areas with the aid of a covering material. The aim here is to achieve the conflicting goals of stiffness and softness without creating edges or stiffeners that reduce wearer comfort or reduce the orthopedic effect.

In order to achieve the orthopedic effect and at the same time the desired wearing comfort and also improve the appearance, PUR support bodies are often provided/covered with a cushioning body or cover material that has the desired properties in terms of cushioning, wearing comfort and appearance. However, the cushioning/cover materials used usually have a negative influence on the orthopedic effect of the PUR support body and vice versa. This is due to the fact that the upholstery and cover materials conventionally used in the prior art usually have a textile carrier layer or an adhesion-promoting carrier layer to make the cushioning and/or cover material bondable to the PUR foam plastic material of the support body and/or to keep the cushioning and/or cover material stable and abrasion-resistant.

However, these carrier layers or adhesion promoter layers not only influence the intrinsic properties of the individual components of a shoe insole in the contact area between the support body and the cushioning material or cover material, but also distort the force transmission of the foot to the sole or change the intended cushioning effect. This is due to the interaction between the carrier and/or adhesive layers of the cushioning body/cover material and the orthopedically functional support body made of PUR foam plastic. For example, a textile carrier layer is disadvantageous in sole areas where good cushioning is to be achieved, as the inherent property of textiles to be tensilely stiff in the longitudinal direction of the threads, i.e. in the textile plane, reduces cushioning at least in this direction. As a result, the desired support and cushioning properties of an underlying PUR support body or cushioning body cannot fully develop, as the textile layer prevents the foot, e.g. the heel bone, from sinking into the cushioning layer. A similar situation applies to the area of the metatarsophalangeal joints, where good cushioning should regularly be achieved. If, however, the carrier or bonding agent layer is tensilely stiff or even rigid in one direction, the cushioning and/or damping properties of the cushioning material applied by means of the carrier or bonding agent layer are also reduced.

On the other hand, elastic bonding layers in areas such as the longitudinal arch area can worsen a firm connection between the cover materials, the poster bodies and/or orthopedic inserts and the support body, as they reduce the stiffness in this area. This means that the combination of supporting body with applied cushioning or cover materials with carrier layers or adhesion promoter layers is always a less than optimal compromise.

A further challenge for the cushioning and cover materials is their abrasion resistance, i.e. a high level of abrasion resistance should be achieved with good cushioning properties and comfort at the same time. These contrasting properties between abrasion resistance and good cushioning properties often lead to multi-layered covers or composite materials, which always represent a compromise between the desired properties. Either the surface facing the foot is abrasion-resistant but then has insufficient cushioning properties or vice versa. Therefore, high cushioning properties often go hand in hand with low abrasion resistance.

Another challenge for the cushioning and cover materials is their ability to bond with the PUR material of the supporting body. Textile materials, such as fleece or similar, are penetrated by the not yet cured PUR material during the foaming process and form a more or less hard intermediate layer after curing. This impairs the flexibility as well as the elasticity and damping properties of the PUR foam plastic used for the support body and the cushioning or cover materials used in the boundary layer between the cover material and the PUR foam plastic, at least on the upper side of the PUR support body or on the underside of the cushioning body. In addition, the pressure load or force transmission of the foot to the shoe insoles is only transmitted indirectly and in a distorted manner, to the point that selective cushioning, for example in the forefoot area, is made almost impossible, especially in the area of the metatarsophalangeal joints.

SUMMARY OF THE INVENTION

It is therefore an object of the invention to provide a foam plastic shoe insole blank, the support body of which is produced using the RIM foaming process and which has at least one cushioning body or a cover material on its upper side and/or underside facing the foot, which does not negatively influence the support properties of the support body and improves the cushioning properties of the support body. The cushioning body should also be abrasion-resistant and have the necessary resilience so that even punctual pressure loads on the supporting body of the shoe insole blank can be reliably transmitted. Furthermore, a shoe insole blank is to be provided which is inexpensive to manufacture, whereby in particular the production of the PUR support body and the connection between the support body and the at least one cushioning body/cover material are not carried out in separate process steps.

The problem according to the invention is solved with an orthopedic PUR foam plastic shoe insole blank. The problem according to the invention is further solved by a method for producing an orthopedic PUR foam plastic shoe insole blank.

The orthopedic PUR foam plastic shoe insole blank according to the invention has a PUR support body which is formed three-dimensionally using the RIM process and supports the foot. The PUR support body has an underside on the shoe side and an upper side on the foot side, on which an anatomically shaped, orthopedically functional footbed is formed. At least one cushioning body is arranged on the foot-side upper side and/or underside of the PUR support body, which is foamed onto the support body during the reactive PUR foaming process. In the remainder of this description of the invention, the term cushioning body should also be understood to mean cover and upholstery materials, as these achieve a more or less strong cushioning effect depending on the material thickness, in addition to visually improving the appearance of the shoe insole blank. The terms cushioning body, cover material and topper material should therefore be understood as synonymous and interchangeable, depending on the requirements for cushioning, wearing comfort and/or decorative properties of the PU sheet material.

In the further course of the description of the invention, the shoe insole blank according to the invention is also abbreviated to shoe insole, which is due to the fact that a shoe insole blank removed from the RIM foaming mold can also be inserted directly into a shoe after a suitable cut to size and replace a missing footbed there, for example. In most cases, however, the shoe insole blank according to the invention is intended to be further processed by an orthopedic specialist, such as a shoe orthopedist, in order to be adapted to the foot of the wearer of the shoe and also to the shoe itself, in particular to be individually adapted. Since the improvement of the prior art achieved with the invention applies both to the shoe insole blank and to the shoe insert, these terms are also used synonymously for the sake of simplicity.

The material for the cushioning body used according to the invention, which can also be referred to as upholstery material or cover material if its material thickness is rather low, is an essentially two-dimensional PU sheet material which has been produced without a carrier layer from a polyurethane starting material by the coagulation process, by the extrusion process or from a dispersion mixture. The PU sheet material used according to the invention has no carrier layer, in particular no textile serving as a carrier. The PU surface material used according to the invention is often referred to in specialist circles as textile-free artificial leather based on polyurethane (PU).

The PU surface material according to the invention is characterized by the fact that the length and width dimensions are significantly greater than the thickness of the material. It is not absolutely necessary for the thickness of the material to be constant over the width and/or length, even if this is the preferred embodiment in most cases. The term surface material is also intended to express the fact that the surface dimensions of the cushioning body or the cover material do not have to correspond to the length and width dimensions of the shoe insole blank, but can be both significantly larger and smaller in its surface dimensions. In the thickness direction, the PU surface material can be thin like a film or, for example, several millimeters or centimeters thick to fulfill the property of a cushioning body.

In particular, it is envisaged that the PU surface material is delivered to and used by the manufacturer of the shoe insole blank according to the invention as sheet, strip, continuous or roll material, and is only suitably cut to length or cut to size before insertion into a RIM foaming mold, i.e. prepared specifically for insertion into a foaming mold.

In contrast to the PUR foam plastic of the PUR support body, which is produced in the so-called reaction foaming process, i.e. in which the polyurethane foam plastic is formed and shaped by bringing together a reactive polyol with a reactive isocyanate in a RIM foaming mold, the cover or upholstery material (=PU sheet material) used according to the invention is processed from a fully reacted polyurethane (PU) present in liquid or solid form by coagulation, dispersion with subsequent drying or by extrusion to form a textile-free PU artificial leather which has no carrier layer, in particular no textile carrier layer.

In a RIM foaming process, a PU sheet material produced in this way can be foamed-on directly with the PUR foam plastic produced in the RIM foaming mold and fixed in place, as the two polyurethane materials bond to each other during curing of the PUR foam plastic without the formation of a stiffened or cured interface layer. Such an interface layer is created when a carrier layer is arranged on the surface material, in particular a textile carrier layer, as the still soft PUR foam plastic penetrates this before the reactively produced PUR foam plastic hardens in the RIM foaming mold, thus creating a PUR foam plastic reinforced by the carrier layer in the interface layer between the supporting body and the cushioning body. In and in the area of the interface, both the support body and the cushioning body then still have (greatly) reduced elastic properties, which not only negatively affects the orthopedic effect of the shoe insole, but also the wearing comfort. Due to the cross-linking/stiffening of the interface, for example, point loads on the support body can no longer be supported at specific points, but are distributed over a wide area, which leads to an overall harder, less soft feeling of support or cushioning, although the hardness of the PUR foam plastic used remains unchanged.

Even if urethane is not the monomer of polyurethane, no stiffened or hardened interface is formed when these two PU materials are joined, because the two PU materials have urethane as a functional group. The properties of the two PU materials are thus largely retained in and in the area of the contact surface of the two sole bodies, whereby a soft, in particular stepless transition of the material properties of the support body to the material properties of the cushioning body takes place in the thickness direction of the shoe insole. This provides a particularly pleasant wearing comfort without compromising the support properties of the PUR foam plastic of the support body or the cushioning properties of the PU cover material (cushioning body). Overall, this means that forces can be continuously transmitted to the insole and cushioned without stiffened interfaces. As a result, the load transmission, the support and cushioning function of the shoe insole can be calculated and predicted more evenly and better, whereby the shoe insole blank according to the invention and thus also the shoe insole manufactured therefrom can be adjusted more precisely and better to the needs of the wearer of the shoe insole.

In addition, orthopedic shoe insole blanks can be individually adapted to the foot or the sole of the foot of the person wearing the shoe insole. This is usually achieved by the fact that the materials used—both for the support body and for the cushioning body—can at least be ground, if not milled. If a cushioning body according to the prior art with a textile carrier layer is milled and/or ground by an orthopedic shoemaker for individual fitting, it is inevitable that the ground areas will have a frayed appearance. Such an unsightly appearance of a ground shoe insole is avoided by the use of a textile-free PU sheet material according to the invention, as no more ground threads can protrude from the shoe insole. Thus, an (individually) adapted and processed shoe insole blank according to the invention also has a more appealing appearance than conventional shoe insole blanks known from the prior art.

According to the invention, it is not mandatory that the cover material or the cushioning body consists of polyurethane (PU) sheet material, but the inventor is not aware of any other suitable cover or cushioning materials that can be joined to reaction-foamed polyurethane (hereinafter PUR) without a carrier layer in such a way that no stiffened or cured interface is formed when the PUR is foamed on and foamed in the RIM foaming mold or after the PUR foam plastic has cured.

When selecting materials, it is also important to ensure that only materials that are classified by the health authorities in the individual countries as harmless to health and are therefore approved for use in the healthcare sector can be used. For example, polyvinyl chloride (PVC) is not approved for shoe insoles in Germany, although PVC can also be used to produce artificial leather. The invention is therefore described on the basis of PU artificial leather as the preferred material. However, the invention can also be applied mutatis mutandis to PVC artificial leather should PVC one day be approved for use in shoe insoles. Should PVC be approved as a cover material for orthopedically functional shoe insoles in other countries outside Germany, then in these countries the term PU sheet material according to the invention should also be understood to mean PVC artificial leather without a carrier layer.

As is readily apparent to those skilled in the art, a PU sheet material without a carrier layer can be made thinner than a cover material with a (textile) carrier layer. This effect is particularly pronounced if a cushioning body is to be formed on the cover material that conforms to the foot, since a stiffening carrier layer should then be as far away from the sole of the foot as possible in order to ensure that the cushioning body conforms to the foot. According to the invention, such a stiffening carrier layer is not required, which makes it possible to make the cushioning body thinner. This effect is further enhanced by the flexibility of the PUR support body, as it no longer forms a rigid counter-bearing, such as a hardened interface or intermediate layer. This is preferable for insoles for diabetics, for example, as material hardening transitions can be cushioned with thinner cushioning bodies, allowing the insoles to be made thinner overall. However, thinner insoles are also preferred for street, sports, leisure and/or work shoes, especially if the insoles of such shoes are not replaceable and the insole is additionally inserted into the shoes. This prevents, for example, that the heel hold through the shoe is lost due to the additional insole.

The use of cover materials or cushioning bodies without a carrier layer according to the invention is further preferred for shoe insoles whose support bodies are provided with recesses which are arranged, for example, in the heel area or in the forefoot area and into which soft cushioning materials are introduced. Here, with the cover material used according to the invention without a carrier layer, both the PUR foam plastic material of the support body and the cushioning material inserted in the recesses can fulfill their function over the entire material thickness and are not inhibited by an orthopedically obstructive hard interface. As a result, the support body with cushioning bodies inside can also be made thinner in the thickness direction of the insole, as there is no stiffening interface at all. Using the PU sheet material without a carrier layer as a cover or cushioning material for a shoe insole according to the invention, loads on the foot as well as force transmissions from the foot to the sole can be transmitted directly through the orthopedically functional materials and are not distorted by a stiffened interface.

The cushioning body or the cover material can only partially or completely cover the upper side and/or underside of the shoe insole blank. Due to the ease with which the two PU materials can be joined together, there is great freedom of design, particularly with regard to the arrangement of cushioning and support areas. Thus, according to the invention, the cushioning body can have a complete shoe sole shape, while at the same time the support body is only formed in orthopedically functional support areas. A person skilled in the art will also recognize here the reverse embodiment possibility, in which cushioning bodies are only formed in the areas in which cushioning of the sole of the foot is required.

This also allows embodiments in which several cushioning bodies and cover materials are used which are either both made of PU sheet material according to the invention, with, for example, the cushioning bodies passing through recesses in the cover materials, or the cushioning bodies being fixed to the support body by means of the cover materials. This can be done, for example, in the manner of a sandwich construction, whereby the supporting body fixes the cushioning body to the cover material and vice versa. This means that the cushioning bodies can be completely covered by the cover material or only partially covered, whereby both the cushioning body and the support body can be immersed and/or visible through the recess in the cover material.

According to the invention, the shoe insole blank is produced using the RIM foaming process. According to the invention, a RIM foaming mold is used, which is usually made up of two foaming mold halves. The first half of the foaming mold forms the upper side of the support body facing the foot with a three-dimensional footbed on the upper side. The second foaming mold half forms the underside of the support body facing the shoe. The shape-giving surfaces of the two mold halves therefore each show a negative image of the upper side or the underside of the support body. In RIM foaming, the reagents—polyol and isocyanate—that form the PUR foam are introduced in liquid form into the lower foaming mold half, usually referred to as the second foaming mold half, through a mixing head. When the two reagents come into contact, they react exothermically to form a PUR foam plastic. In order to create a defined molded body, in this case the support body, a RIM foaming mold has a cavity in the closed state, which is formed by the first half of the foaming mold, usually the upper half of the foaming mold, by placing it on the second half of the foaming mold. After the two foaming mold halves have been assembled, they are locked together so that the expanding PUR foam plastic cannot press open the RIM foam mold. The added reagents can expand in the cavity until they are used up. After a curing time, the foam plastic body produced in this way, in this case the support body, can be removed from the foaming mold.

For the production of a shoe insole blank according to the invention, the PU sheet material of the cushioning body is inserted into the first foaming mold half with the foaming mold open and fixed there or attached thereto in such a way that the PU sheet material at least partially covers the shape-giving surfaces of the first foaming mold half and that the PU sheet material at least adheres to the first foaming mold half during the closing process of the foaming mold and does not fall down.

Before the foaming mold is closed, as already described above, the starting components, i.e. polyol and isocyanate, are introduced in liquid form into the second half of the foaming mold by means of a so-called mixing head. When the two reagents come into contact, they begin to react chemically with each other to form a PUR foam plastic and expand, as is well known in the prior art and described above. It is therefore necessary to close the foaming mold as quickly as possible after introducing the reagents. This is usually done in a guided linear and/or folding movement. The closed mold is then locked or held shut. This locking or holding force can be used to finally hold the PU sheet material inserted into the first half of the foaming mold if it is so large that it protrudes beyond the shape-giving surfaces. This clamps and fixes the PU sheet material in the parting plane of the two mold halves, for example.

As the reagents for the PU foam plastic have already been introduced into the lower half of the foaming mold before the foaming mold is closed and can now expand in the cavity to form the PU foam plastic, the PU sheet material in the closed foaming mold is now also foamed-on by the expanding PU foam plastic. This forms a material bond between the PU sheet material and the PU foam plastic. At the same time, the PU sheet material is pressed against the shape-giving surfaces of the first half of the foaming mold by the PU foam plastic being formed and deforms into the shape of a three-dimensional footbed, which is formed by the shape-giving surfaces of the first half of the foaming mold. After the end of the foaming process, i.e. after the end of the reaction of the two initial components, the PUR foam plastic has hardened and the foaming mold can be opened. Now the foam plastic shoe insole blank produced according to the invention can be removed from the foaming mold.

Depending on how the PU sheet material is cut and fixed, it may need to be cut to the shape of the shoe sole so that it can be further processed by an orthopedic specialist. Such a cut shoe insole blank can also be inserted directly into a shoe, as described above, for example when replacing an insole.

According to the invention, there are various possibilities for inserting the PU sheet material or the cushioning body. One is to use a protective film that adheres to the cushioning body and can be peeled off, with which the cushioning body/the PU sheet material is inserted into the first foaming mold half with the protective film facing the shape-giving surfaces. The protective film adheres at least so lightly to the inside of the first foaming mold half that it does not detach from the first foaming mold half when the foaming mold is closed. When the foaming mold is closed, the protective film with the PU sheet material attached to it can then be clamped in the parting plane formed between the two foaming mold halves and holds the cushioning body in its intended orthopedically functional position.

After the RIM foaming molding process, the protective film can be easily removed from the shoe insole blank produced in this way, as it is attached to the cushioning body in a removable manner. According to the invention, it does not matter when the protective film is removed, but this should be done at a time before the wearer of the shoe insole starts using it.

Another possibility is to cut the PU sheet material so generously that the PU sheet material is clamped directly in the mold parting plane of the two foaming mold halves when the foaming mold is closed. This is particularly preferable if the PU sheet material is relatively thin and thus a negative influence on the parting plane can be avoided. At the same time, the PU sheet material can seal the parting plane so that no PUR foam plastic can escape from the cavity.

In a further embodiment of the manufacture of the shoe insole blank according to the invention, the protective film described above can also be a cover material which remains on the shoe insole blank. This was previously bonded to the PU sheet material, for example.

In a further embodiment in which a cushioning body made of PU sheet material is to be applied to a RIM support body according to the invention, a cover material or a protective film is inserted into the first half of the foaming mold to which the cushioning body adheres or is attached. The cushioning body does not need to cover the entire footbed, but can only be arranged in partial areas of the finished shoe insole. In this embodiment, the cover material or the protective film only serves to position or fix the cushioning body or another orthopedically functional component in its orthopedically intended position. In this case, the cushioning body is therefore held in its orthopedically predetermined position in the RIM foaming mold by the cover material during the foaming process, i.e. during the expansion phase of the foam plastic. Just like the cushioning body described above, other orthopedically functional components such as pads, support wedges, heel wedges and similar orthopedic components known to the orthopedic specialist can also be fixed in the predetermined position in the finished shoe insole by means of the cover material or the PU sheet material.

In a further preferred embodiment of the invention, an injection-molded part is injected onto the cushioning body before the cushioning body is inserted into the foaming mold. For this purpose, the PU sheet material is first introduced into an injection mold, or the PU sheet material is fixed there, for example by suspending it, in such a way that the injection-molded part is injected onto the PU sheet material in an orthopedically desired and predetermined position and the injection-molded part together with the PU sheet material can be transferred to the first foaming mold half of the RIM foaming mold, so that the injection-molded part is also held in the orthopedically predetermined position by the cushioning body, i.e. by PU sheet material, in the RIM foaming mold.

Preferably, the injection-molded part injected onto a cushioning body made of PU sheet material is arranged on the underside of the shoe insole blank, since such injection-molded parts are usually made of relatively hard materials so that they can exert a good supporting effect on the foot. To ensure that the upper side of the shoe insole blank according to the invention nevertheless exhibits a soft and elastic cushioning property, it is preferable to arrange the PUR support body above the injection-molded part, i.e. on the upper side, so that the support body can be regarded as a kind of cushioning body for the injection-molded part.

According to the invention, the injection-molded part arranged on the cushioning body or on the PU sheet material is preferably inserted into the second foaming mold half, the shape-giving surfaces of which form the underside of the support body. The injection-molded part can be arranged facing the shape-giving surfaces or facing away from the shape-giving surfaces in the second foaming mold half, depending on whether the injection-molded part is to be processable on the molded shoe insole blank or not. If the injection-molded part faces the cavity, it is at least partially covered by the PU sheet material in the RIM-molded shoe insole blank, as the cushioning body made of PU sheet material holds the injection-molded part in the desired predetermined position and faces the shape-giving surfaces of the second foaming mold half during RIM foaming. Conversely, when the injection-molded part faces the shape-giving surfaces of the second foaming mold half, the injection-molded part is visible on the underside of the shoe insole blank after removal of the shoe insole blank and can be processed, for example by an orthopedic specialist.

The method according to the invention for producing a shoe insole blank was described above with reference to the use of only one single PUR foam plastic, which, as is known to the person skilled in the art, can also be carried out in an analogous manner with two or more PUR foam plastics, preferably with different material hardnesses. The starting materials for the two or more PUR foam plastics can be produced simultaneously in one and the same foaming mold. For this purpose, different mixtures or different amounts of polyol and isocyanate are introduced into the second foaming mold at different points simultaneously by several mixing heads or by one mixing head in quick succession, which can then expand in parallel in the closed foaming mold. If no mechanical flow boundaries are provided, the resulting material fronts are formed depending on the reaction speed of the individual PUR foam plastics produced. It is therefore difficult to form a clear, reproducible material front, especially as the PUR foam plastics run into each other and mix in some areas.

BRIEF DESCRIPTION OF DRAWINGS

The above explanations of the orthopedic PU shoe insoles according to the invention and of the method according to the invention for producing such an orthopedic shoe insole blank are explained in more detail below with reference to figures of preferred embodiments. The further explanations provided are not intended to limit the idea of the invention to these embodiments. They are for illustrative purposes only. The figures show.

DETAILED DESCRIPTION OF THE INVENTION

Figure 1:
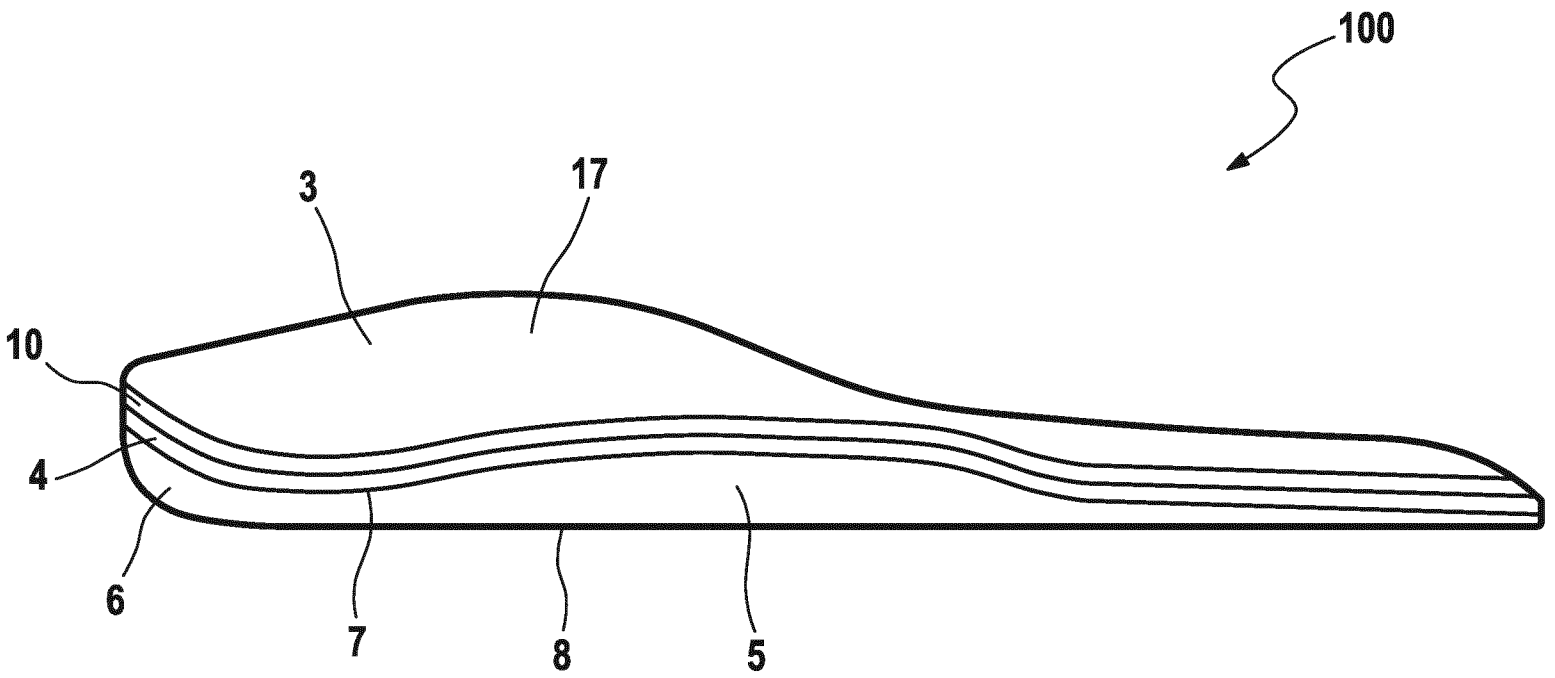
Fig. 1 (Prior Art)
FIG. 1 schematically shows a longitudinal section through an orthopedic shoe insole blank according to the prior art.

FIG. 1 shows a shoe insole 100 known from the prior art schematically in a longitudinal section. The shoe insole 100 shows an upper-side footbed 3, which is formed on the upper side 7 of a supporting body 6 made of PUR foam plastic 5. The footbed is covered with a cushioning body 10, with a carrier layer 4 as a connecting, adhesion-promoting layer holding the cushioning body 10 on the supporting body 6. In this case, this adhesion-promoting layer 4 extends over the entire surface of the shoe insole 100.

Figure 2:
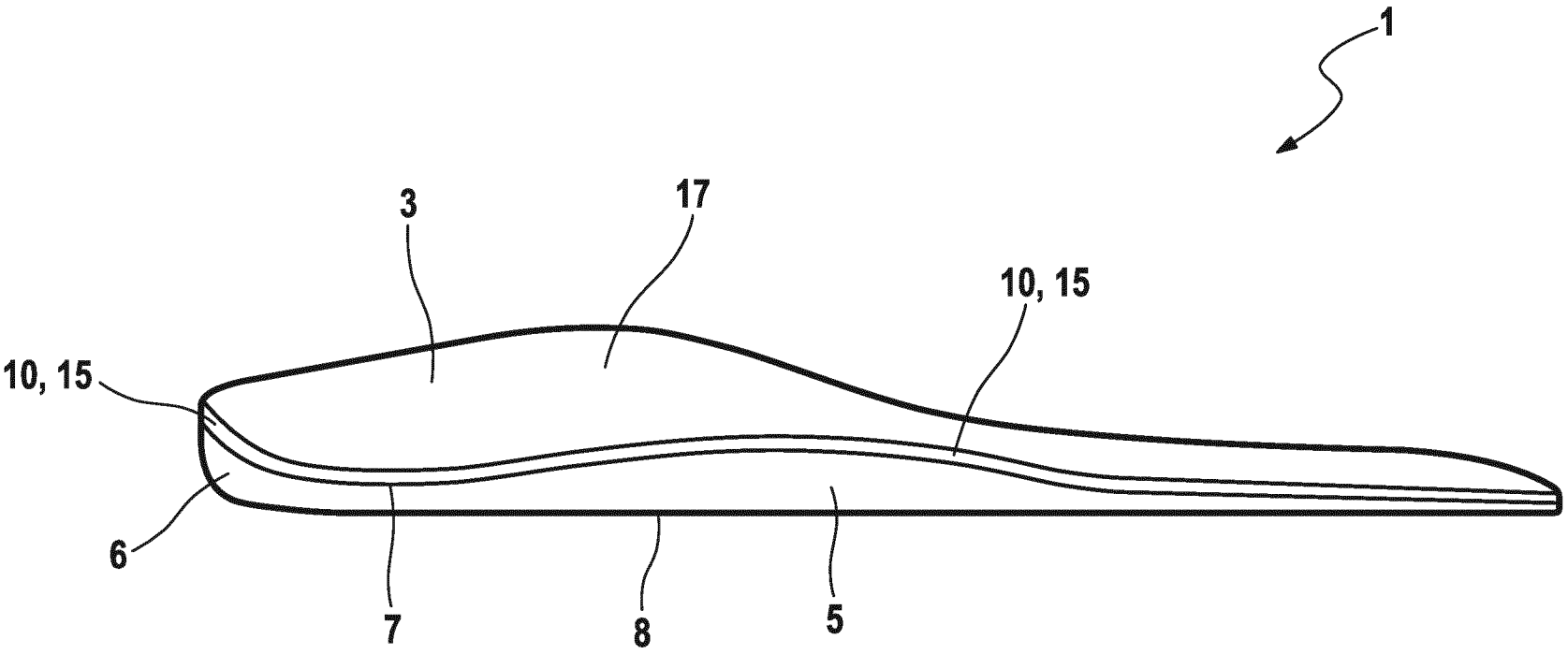
FIG. 2 schematically shows a longitudinal section through an orthopedic shoe insole blank according to a first embodiment of the invention.

FIG. 2 also shows a shoe insole blank 1 according to the invention in a schematic longitudinal section. The shoe insole blank 1 according to the invention also shows a footbed 3, which is arranged on the upper side of a supporting body 6 formed from PUR foam plastic 5. The support body 6 of the shoe insole blank 1 according to the invention is also covered with a cushioning body 10 which, however, is joined directly to the support body 6 by a substance-to-substance bond without any adhesion-promoting or connecting carrier layer. The adhesion-promoting layer 4 known from the prior art, as shown in FIG. 1, can be omitted according to the invention, since the material of the cushioning body 10 bonds with the RIM foam plastic 5 during the RIM foaming of the supporting body 6. Thus, in its simplest embodiment, the shoe insole blank 1 according to the invention has two layers, whereby currently known shoe insole blanks 100 must have at least three layers due to the presence of a carrier layer 4. The advantages of a 2-layer design of a shoe insole blank have already been explained above in the general part of the description of the invention.

Figure 3:
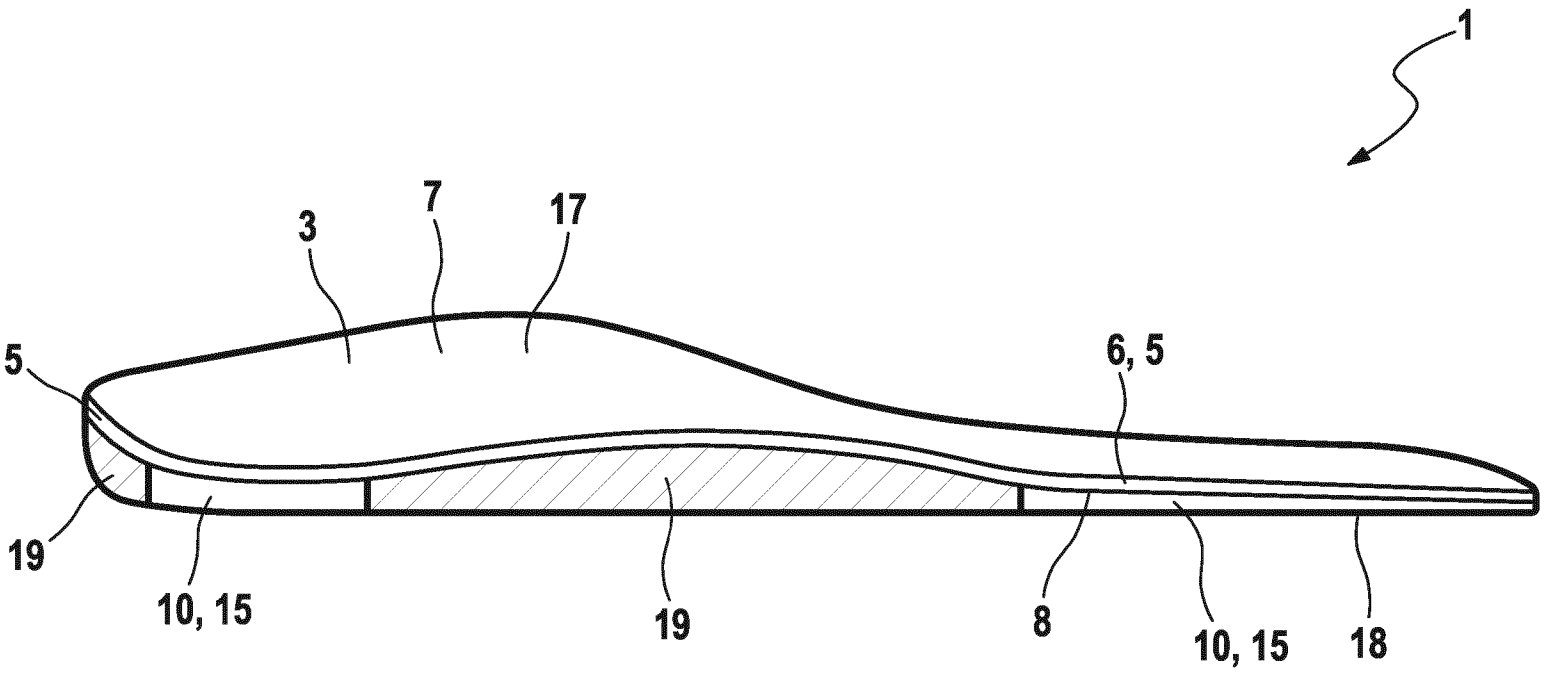
FIG. 3 schematically shows a longitudinal section through an orthopedic shoe insole blank according to a second embodiment of the invention.

FIG. 3 shows a shoe insole blank according to the invention in a second embodiment, in which the cushioning body 10 is arranged on the underside 8 of the supporting body 6, i.e. forms the underside 18 of the shoe insole blank 1. In this embodiment, the upper side 7 of the supporting body 6 simultaneously forms the upper side 17 of the shoe insole blank 1. As a person skilled in the art will readily recognize, the upper side 7 of the supporting body 6 can be provided with a further covering material 25, which can also be applied subsequently to customize the shoe insole blank, for example by grinding or milling. The shoe insole blank 1 shown schematically in FIG. 3 also shows a support part 19 arranged in the heel area 13. The support part 19 is preferably injection-molded onto the cushioning body 10 before the cushioning body 10 is inserted into the foaming mold half that forms the shoe-facing underside 18 of the shoe insole blank 1. According to the invention, the injection-molded part 19 is injected onto the PU sheet material 15 of the cushioning body 10 in such a way that it can be inserted and fixed together with the latter in the RIM foaming mold in such a way that the injection-molded part 19 is held in the desired predetermined position by the cushioning body 6 during RIM foaming. As described above, the cushioning body 10 can, for example, be clamped in the parting plane of the two foaming mold halves when the RIM foaming mold is closed, so that neither the cushioning body 10 nor the injection molded part 19 slips during the expansion of the PUR foam plastic in the RIM foaming mold and the injection molded part 19 is held securely in the desired predetermined orthopedically functional position.

Figure 4:
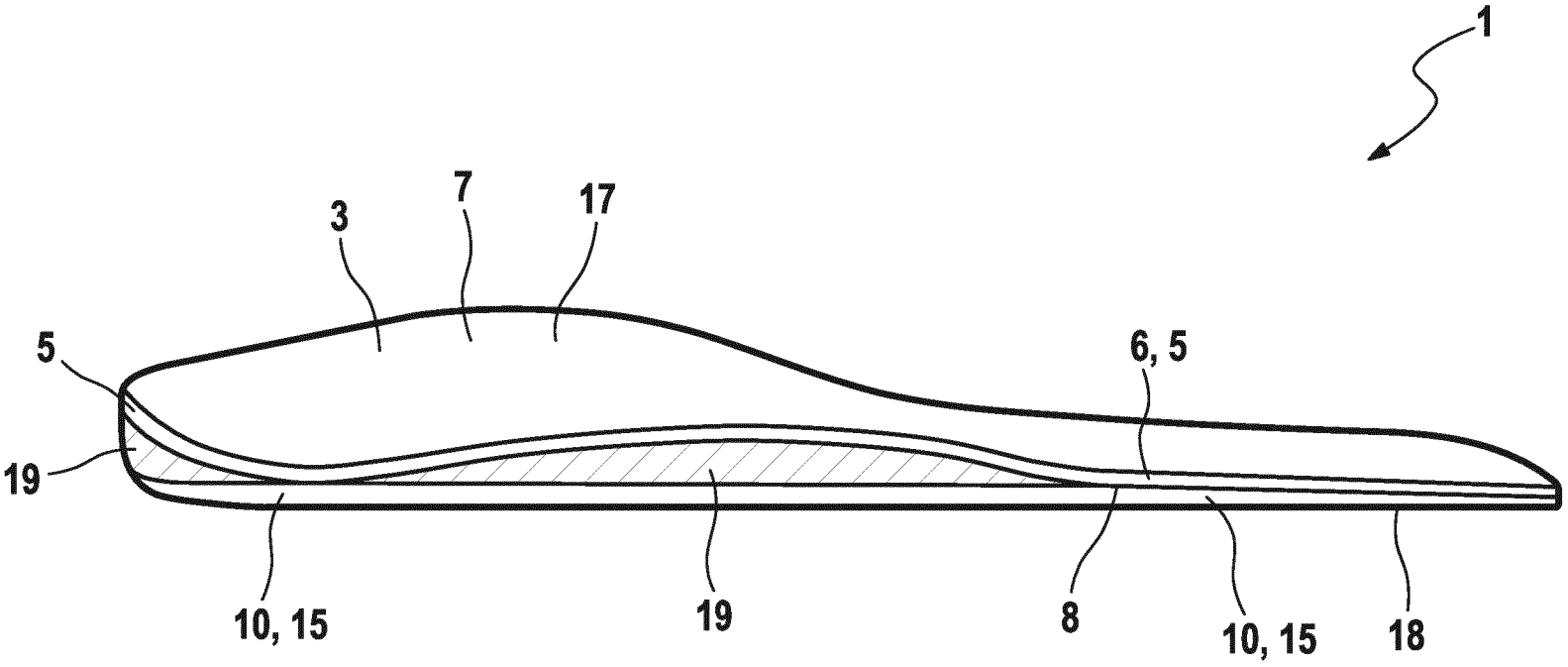
FIG. 4 schematically shows a longitudinal section through an orthopedic shoe insole blank according to a third embodiment of the invention.

FIG. 4 shows a third embodiment of a shoe insole blank 1 according to the invention with an inside injection-molded part 19, which is arranged on the underside 8 of the support body 6, in a modification of the embodiment of FIG. 3. In this embodiment, the PU sheet material 15 of the cushioning body 10 forms the underside 18 of the shoe insole blank 1. As in the embodiment of FIG. 3, the supporting body 6 is arranged on the upper side 17 of the shoe insole blank 1 and can be provided with a further cushioning body 10 and/or a cover material 25, as shown, for example, in the further embodiments of FIGS. 5 and 6. In contrast to the embodiment of FIG. 3, in the embodiment according to FIG. 4, the injection-molded part 19, which is injected onto the PU sheet material 15 of the cushioning body 10, was inserted together with the cushioning body 10 into the RIM foaming mold in such a way that the injection-molded part 19 faced the cavity during RIM foaming. The cushioning body 10 covered the shape-giving surfaces of the second RIM foaming mold half, which form the shoe-facing underside 18 of the shoe insole blank 1. Thus, the exemplary embodiment according to FIG. 4 shows an injection-molded part 19 completely covered by the PU sheet material 15 of the cushioning body 10, although this is not mandatory. It is also conceivable that the PU sheet material has recesses 16 through which the injection-molded part 19 emerges onto the surface and can be visibly processed there, for example by an orthopedic specialist.

Figure 5:
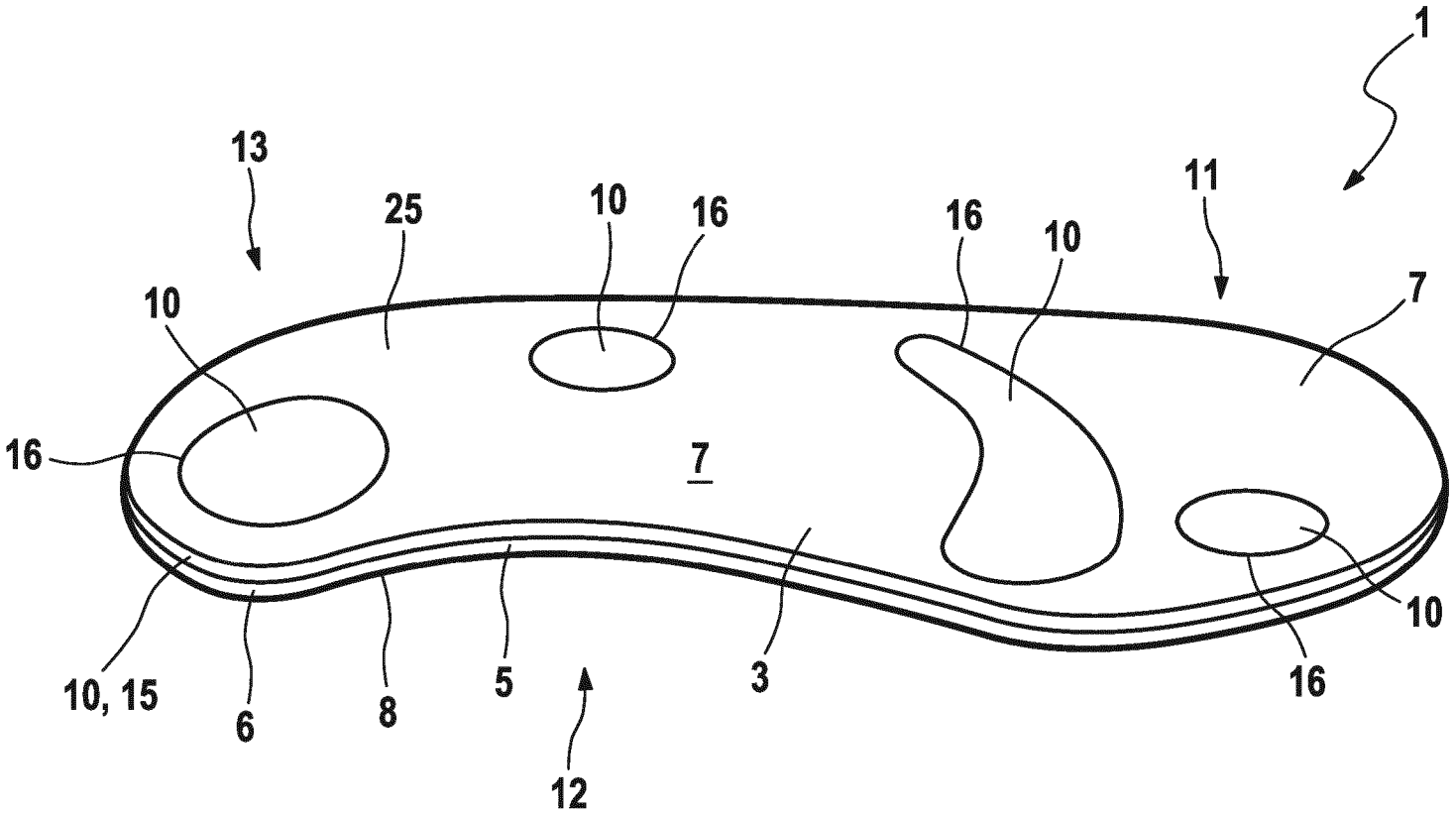
FIG. 5 is a schematic perspective view of a fourth embodiment of an orthopedic insole blank according to the invention.

FIG. 5 shows perspectively and exemplarily a fourth embodiment for a shoe insole blank 1 according to the invention in which, for example, a shoe insole blank 1 according to FIG. 2 is covered with a further covering material 25. In the covering material 25, which can also be a PU sheet material but does not have to be, one or more recesses 16 are arranged in the toe area 11 in the middle area 12 and in the heel area 13 of a sole of the foot. Through these recesses 16, the cushioning body 10 comes into direct contact with the sole of the foot of the wearer of the shoe insole. In this case, the cushioning bodies 10 can be connected to one another below the additional cover material 25 or can be separate cushioning bodies 10 that are individually connected to the support body 6. Separate cushioning bodies 10 can be used to individually adapt the orthopedically required cushioning and support requirements in the individual areas. For example, softer cushioning bodies 10 can be used in the area of the metatarsophalangeal joints in the transition from the forefoot area 11 to the midfoot area 12 than, for example, for the cushioning of the big toe.

Figure 6:
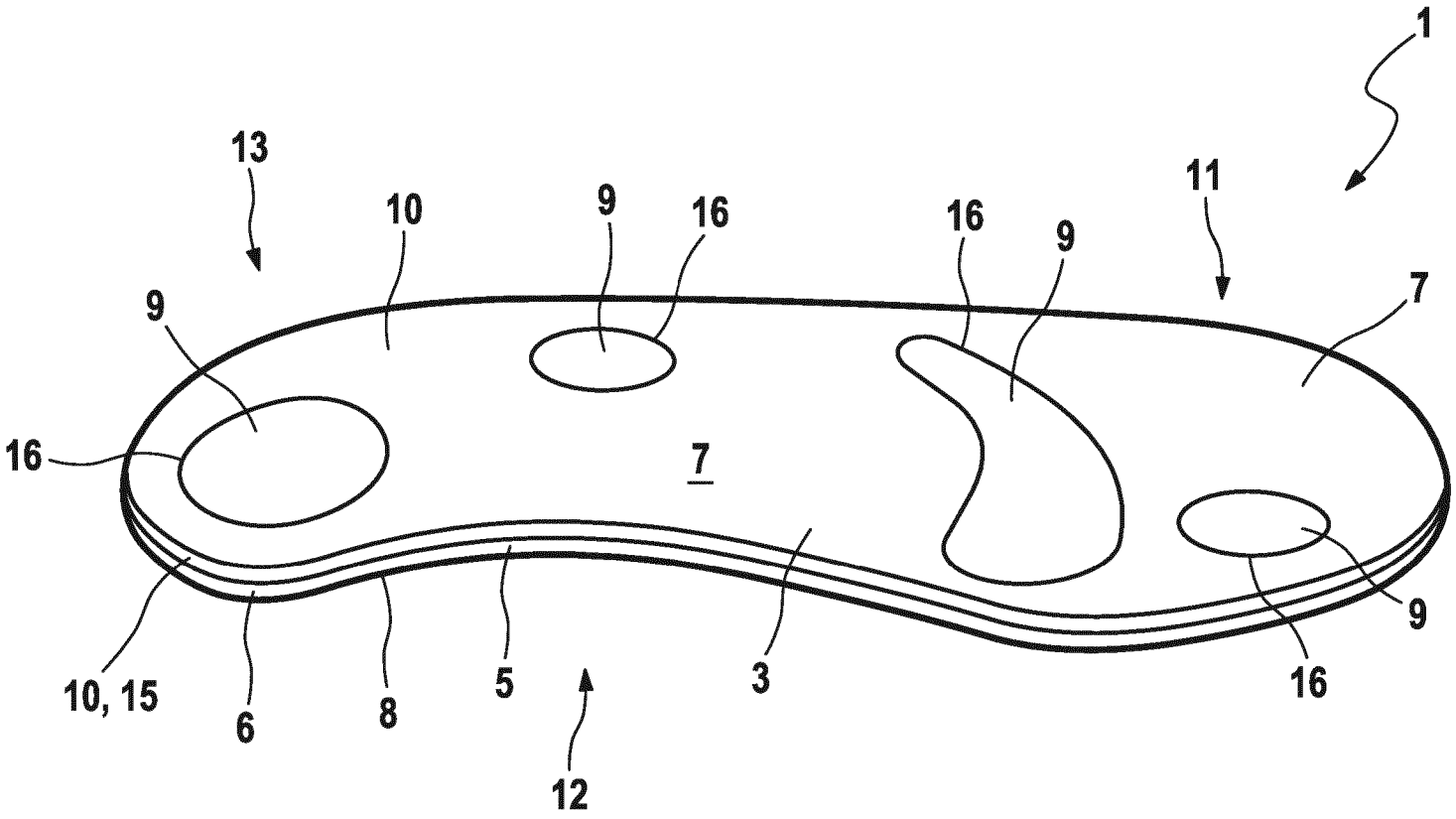
FIG. 6 is a schematic perspective view of a fifth embodiment of an orthopedic insole blank according to the invention.

From FIG. 6, the skilled person recognizes that an arrangement and fixing of inserts, in particular orthopedically functional components 9, such as pads, heel wedges, longitudinal arch supports, etc., which are at least partially visible through recesses 16 arranged in a cushioning body 10, can be carried out analogously to FIG. 4. Embodiments in which the orthopedically functional components 9 are completely covered by the cushioning body 10 are also included. With this embodiment, orthopedically functional components 9 which cannot be materially bonded to PUR foam plastic can be securely fixed to the shoe insole blank 1 according to the invention as inserts by means of the cushioning body 10 made of PU sheet material 15 which can be materially bonded to the supporting body 6.

As previously shown, the individual embodiments of FIGS. 1 to 6 can be combined with one another without deviating from the idea of the invention. In accordance with the invention, shoe insole blanks can in particular be produced which show one or more cushioning bodies 10 both on the upper side 17 of the shoe insole blank 1 and on its underside 18. In this case, the PU sheet material 15 of the one or more cushioning bodies 10 or that of the cover materials 25, which are additionally applied to the upper side 17 and/or lower side 18 of the shoe insole blank 1 according to the invention, can have recesses 16 through which an injection-molded part 19 and/or the PU sheet material 15 of the one or more cushioning bodies 10 are visible. The skilled person will recognize here a large number of possible combinations, all of which are linked by the inventive idea of using a carrier layer-free PU sheet material 15 as the cushioning body 10.

The invention claimed is:

1. An orthopedic reaction-foamed polyurethane (PUR) foam plastic shoe insole blank comprising:

at least one cushioning body; and a PUR supporting body that is shaped three-dimensionally in a reaction injection molding (RIM) process, supports a foot, and has a shoe-side underside and a foot-side upper side on which an anatomically shaped, orthopedically functional footbed is formed, wherein the at least one cushioning body consists of a prefabricated, two-dimensional polyurethane sheet material that has no carrier layer and that was produced by coagulation, extrusion or from a polyurethane dispersion mixture, and wherein the at least one cushioning body is fixed at the upper side and/or at the underside of the PUR supporting body in a contact-foamed, materially integral manner during an expansion of a RIM foam plastic for forming the PUR supporting body in a shaping RIM foaming mold.

2. The shoe insole blank according to claim 1, wherein the at least one cushioning body only partially covers an upper side of the shoe insole blank or completely covers the upper side of the shoe insole blank, or the PUR supporting body is arranged only in partial areas of the shoe insole blank.

3. The shoe insole blank according to claim 1, wherein a covering material is applied to the PUR supporting body and/or the at least one cushioning body, and the covering material covers the cushioning body or has cutouts through which the cushioning body and/or the PUR supporting body is at least partially visible.

4. The shoe insole blank according to claim 1, wherein two or more cushioning bodies are fixed in a materially integral manner to the upper side and/or the underside of the PUR supporting body.

5. The shoe insole blank according to claim 3, wherein the covering material has been fixed to the PUR supporting body and/or the cushioning body in a materially integral manner during the RIM foaming of the PUR supporting body.

6. The shoe insole blank according to claim 1, wherein the PUR supporting body is made of a plurality of PUR foams of different material hardnesses and/or colors.

7. The shoe insole blank according to claim 1, comprising two PUR supporting bodies that are formed at least partially on different sides of the cushioning body, so that the orthopedically functional footbed is formed together by one or both of the two PUR supporting bodies.

8. The shoe insole blank according to claim 1, wherein, before the cushioning body is foamed with the PUR foam plastic, an orthopedically functional injection-molded part is bonded to the cushioning body using an injection molding process to form the cushioning body, which is held by the cushioning body at an orthopedically predetermined position at least during the expansion of the RIM foam plastic for the purpose of producing the PUR supporting body.

9. The shoe insole blank according to claim 8, wherein the injection-moulded part is arranged on the underside of the PUR supporting body, and wherein the injection-moulded part is arranged visibly on an underside of the shoe insole blank or is covered by the cushioning body.

10. The shoe insole blank according to claim 1, wherein the PUR supporting body and/or the cushioning body can be ground and/or thermoformed for individual adaptation to a wearer of a shoe insole.

11. The shoe insole blank according to claim 1, wherein the shoe insole blank is subsequently covered with one or more covers on a side of the footbed and/or on the underside of the PUR supporting body.

12. A method for manufacturing the PUR foam plastic shoe insole blank according to claim 1, with the PUR supporting body shaped in the RIM foaming process, which has a three-dimensional orthopedic footbed on the upper side, and with at least one cushioning body arranged on an upper side of the footbed, made of a polyurethane sheet material that has no carrier layer and that has been produced by coagulation, extrusion or from a polyurethane dispersion mixture, the process comprising the steps of:

a) inserting and fixing at least one cushioning body made of polyurethane sheet material in a first foaming mold half of a RIM foaming mold, which by means of first shape-giving surfaces forms the foot-facing upper side of the PUR supporting body as a three-dimensional footbed, or into a second foaming mold half of the RIM foaming mold, which forms the underside of the PUR supporting body facing the shoe by means of second shape-giving surfaces;

b) applying reagents that produce the PUR foam plastic to the second shape-giving surfaces of the second foaming mold half of the RIM foaming mold;

c) closing the RIM foaming mold while molding the cushioning body to the PUR supporting body by means of the expanding PUR foam plastic; and d) opening the RIM foaming mold after the hardening time for the PUR foam plastic has elapsed and removing the shoe insole blank.

13. The method according to claim 12, wherein the cushioning body is inserted, adhering to a peelable protective film, into the first foaming mold half of the RIM foaming mold in such a way that the protective film faces the first shape-giving surfaces of the RIM foaming mold, and wherein the protective film can remain on the cushioning body after removal of the shoe insole blank or the protective film can be removed from the cushioning body without leaving any residue.

14. The method according to claim 12, wherein the cushioning body is inserted, adhering to a peelable protective film, into the first foaming mold half of the RIM foaming mold in such a way that the protective film faces the first shape-giving surfaces of the RIM foaming mold, with the protective film projecting beyond the first shape-giving surfaces of the RIM foaming mold and being fixed to an edge of the RIM foaming mold in a parting plane of the RIM foaming mold before or during the closing of the RIM foaming mold in order to secure the cushioning body against shifting during the RIM foaming, wherein the shoe insole blank is cut or punched into a shoe sole form after removal from the RIM foaming mold.

15. The method according to claim 13, wherein the protective film is a shoe sole covering material for the shoe insole blank and the protective film has recesses through which parts of the cushioning body and/or the PUR supporting body come into direct contact with the shape-giving surfaces of the RIM foaming mold.

16. The method according to claim 12, wherein, before closing the RIM foaming mold, orthopedically functional components are inserted into the first foaming mold half or second foaming mold half in a slip-proof manner or, before step a), an injection-molded part is injection-molded onto the cushioning body in such a way that the cushioning body holds the injection-molded part in an orthopedically predetermined position at least during steps b) and c), and the injection-molded part is arranged on the underside of the PUR supporting body or on the underside of the shoe insole blank after step d).

* * * * *